United States Patent [19]

Cook

[11] Patent Number: 5,035,121

[45] Date of Patent: Jul. 30, 1991

[54] BEVERAGE COOLING AND PUMPING SYSTEM

[75] Inventor: Christopher M. Cook, Eastbourne, England

[73] Assignee: IMI Cornelius Inc., Anoka, Minn.

[21] Appl. No.: 557,879

[22] Filed: Jul. 25, 1990

[51] Int. Cl.[5] ..... B67D 5/62

[52] U.S. Cl. ..... 62/389; 62/392; 62/394; 222/146.6

[58] Field of Search ..... 62/392, 394, 395, 389; 222/146.6

[56] References Cited

U.S. PATENT DOCUMENTS

| | | | |
|---|---|---|---|
| 2,440,397 | 4/1948 | Erickson | 62/392 X |
| 2,745,641 | 5/1956 | Jacobs | 62/392 X |
| 3,400,551 | 9/1968 | Booth et al. | 62/392 X |
| 4,537,332 | 8/1985 | Brown et al. | 62/392 X |
| 4,696,417 | 9/1987 | Ugolini | 62/392 X |

FOREIGN PATENT DOCUMENTS

| | | |
|---|---|---|
| 0244801A2 | 11/1987 | European Pat. Off. . |
| 2167845B | 9/1988 | United Kingdom . |

*Primary Examiner*—Lloyd L. King

*Attorney, Agent, or Firm*—Sten Erik Hakanson

[57] ABSTRACT

An agitating and pumping device particularly for use with a beverage cooling and dispensing ice-bank system. The ice-bank includes a reservoir for holding water and refrigerating coils therein for cooling the water. A heat exchange circuit is in heat exchange relationship with the reservoir water for cooling beverage circulated therethrough. The agitating and pumping device includes an electric motor for driving a shaft having agitating blades secured thereto. A pump is magnetically coupled to the shaft and is fluidly connected to the heat exchange circuit and to a source of beverage. The motor is secured above the reservoir with the agitating blades and pump submerged in the reservoir water. Operation of the motor provides for agitating of the reservoir water and for the pumping of the beverage through the heat exchange circuit.

26 Claims, 2 Drawing Sheets

BEVERAGE COOLING AND PUMPING SYSTEM

BACKGROUND

1. Field of the Invention

This invention relates generally to ice-bank beverage or beverage component cooling systems and, more specifically to the pumping and agitating components thereof.

2. Background of the Invention

Ice bank cooling systems are well known. Such systems incorporate a reservoir containing water and two sets of coils. The first coil comprises the expansion portion of a refrigeration circuit and the second coil is a heat exchanger for cooling beverage or a beverage component, such as a concentrate or carbonated water. Operation of the refrigeration system builds up a layer of ice on the refrigerant coils which acts as a source or store of cooling ability, and enables a smaller refrigeration unit to cool beverages where the demand occurs in peaks throughout the day. Normally, such systems incorporate an agitator in the form of a paddle rotated by an electric motor which agitates water within the reservoir to wash it over the ice bank to keep the water cold and prevent temperature stratification within the resevoir.

In a particular type of ice-bank system, there is provided a re-circulating loop through which a beverage portion, typically carbonated water, is continuously pumped and is tapped off at locations therearound for supply to a post-mix dispensing valve. A major portion of the loop is the heat exchanging coil, and thus, the carbonated water in the loop is always maintained at a suitable dispensing temperature. The carbonated water is pumped by means of a conventional electrical pump which, therefore, has to handle the cold carbonated water. Such pumps normally operate continuously to circulate the chilled water through the soda circuit. A problem with such a system concerns the location of the pump on the exterior of the reservoir in the ambient air. As the pump will typically be substantially colder than the ambient conditions due to the pumping of the soda water, any moisture in the air will therefore have a tendency to condense on the pump resulting in corrosive damage thereto and to that portion of the reservoir in the immediate vicinity of the pump.

A further problem with such prior art ice bank systems concerns the driving of the pump wherein the pump is operated by connection thereof to a drive shaft of an electric motor. This manner of connection inherently requires the use of seals around the shaft. A problem can arise if the integrity of the seals is compromised and contaminants are allowed to enter the flow of the carbonated water.

SUMMARY OF THE INVENTION

By the present invention there is provided a beverage or beverage component cooling and pumping system including a reservoir of coolant liquid, an agitator for agitating liquid in the reservoir, power means located above the reservoir and connected to the agitator to rotate the agitator, and a pump for pumping the beverage or beverage component through a cooling dispensing circuit. The pump is driven by the same power means as the agitator wherein the pump is magnetically coupled to the agitator.

The magnetic coupling eliminates any shaft seals, and the like, that could wear and allow contamination of the carbonated water beverage component. The pump can therefore be very effectively and permanently sealed from its external environment thereby virtually eliminating the chance of beverage contamination. As a result of such sealing it was found that the pump can also be totally immersed within the coolant reservoir providing the added advantages of doing away with the condensation related corrosion thereof and removing the pump as a source for the addition of unwanted heat to the carbonated water.

In a further embodiment, the pump is located on the exterior of a bottom wall of the reservoir, wherein such bottom wall is formed, at least in part, of a non-ferromagnetic material for permitting magnetic coupling of the agitator end and pump therethrough. The pump, when mounted in an exterior position, is thermally insulated from the external atmosphere.

DESCRIPTION OF THE DRAWINGS

Further understanding of the structure, operation, objects and advantages of the present invention can be had in light of the following detailed description which refers to the figures below, wherein.

DETAILED DESCRIPTION OF THE PREFERRED EMBODIMENTS

Figure 1:
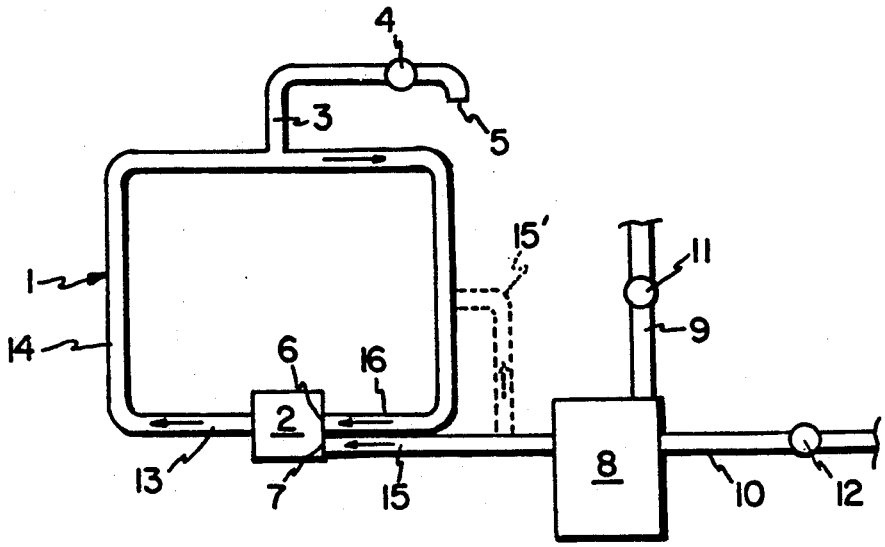
FIG. 1 is a schematic view of the fluid circuit of the present invention.

Referring to FIG. 1, a fluid circuit is shown and generally designated 1. Circuit 1 incorporates a T-fitting 3. Fitting 3 provides for fluid communication to a valve 4 which controls a flow of carbonated water to an exit point or nozzle 5. It will be understood that the system beyond fitting 3 is perfectly conventional and valve 4 may be of the post-mix type for mixing carbonated water with a drink concentrate, or may be a simple control valve.

Pump 2 has a pair of inlets 6 and 7. Inlet 6 is for the return from loop 1, and inlet 7 is for replenishment of carbonated water from a carbonator 8. Pump 2 runs continuously and normally circulates water around circuit 1. In the event of carbonated water being drawn through valve 4, replenishment of loop 1 is provided by carbonator 8. Carbonator 8 is supplied by a carbon dioxide line 9 and a water line 10 incorporating valves 11 and 12 respectively for providing regulated connection to sources of carbon dioxide and potable water (not shown). Carbonator 8 is remote from circuit 1 and is of conventional form.

Figure 2:
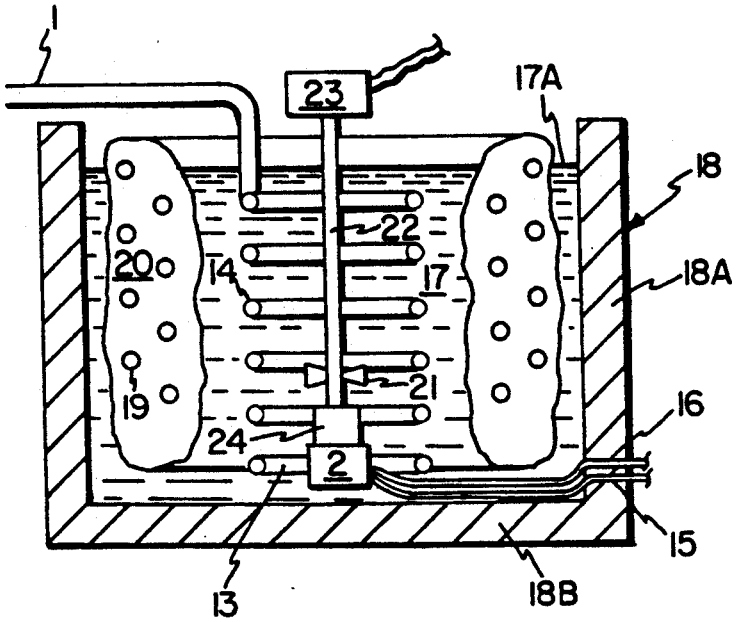
FIG. 2 is a schematic cross-sectional view of a coolant reservoir.

As seen in FIG. 2, pump 2 has an output through a line 13 for fluid connection to a heat exchanging coil 14 which forms part of circuit 1. Feed line 15 from carbonator 8 leads to feed port 7, and feed line 16 leads to port 6. Feed line 15 or pump 2 include a check valve (not shown) for insuring the one directional flow of carbonated water from carbonator 8 to pump 2. Pump 2 is immersed in water 17 contained within an insulated reservoir 18. Reservoir 18 includes rigid insulated sidewalls 18*a* and bottom wall 18*b*, and a rigid cover 18*c* is releasably secured to sidewalls 18*a*. Also, within reservoir 18, is a refrigeration coil 19 connected to a refrigeration means (not shown) for producing an ice-bank 20 in a conventional manner. Water 17 has a top surface 17*a* and is agitated by agitator paddle or blades 21, located below surface 17*a*, and fixed to shaft 22 and driven by an electric motor 23. A magnetic coupling 24 interconnects shaft 22 and pump 2.

Figure 4:
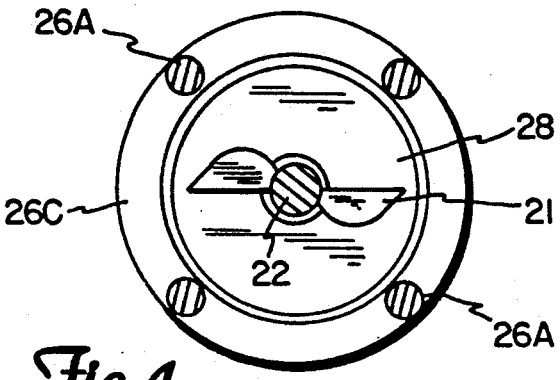
FIG. 4 is a cross-sectional view along lines 4—4 of FIG. 3.
Figure 3:
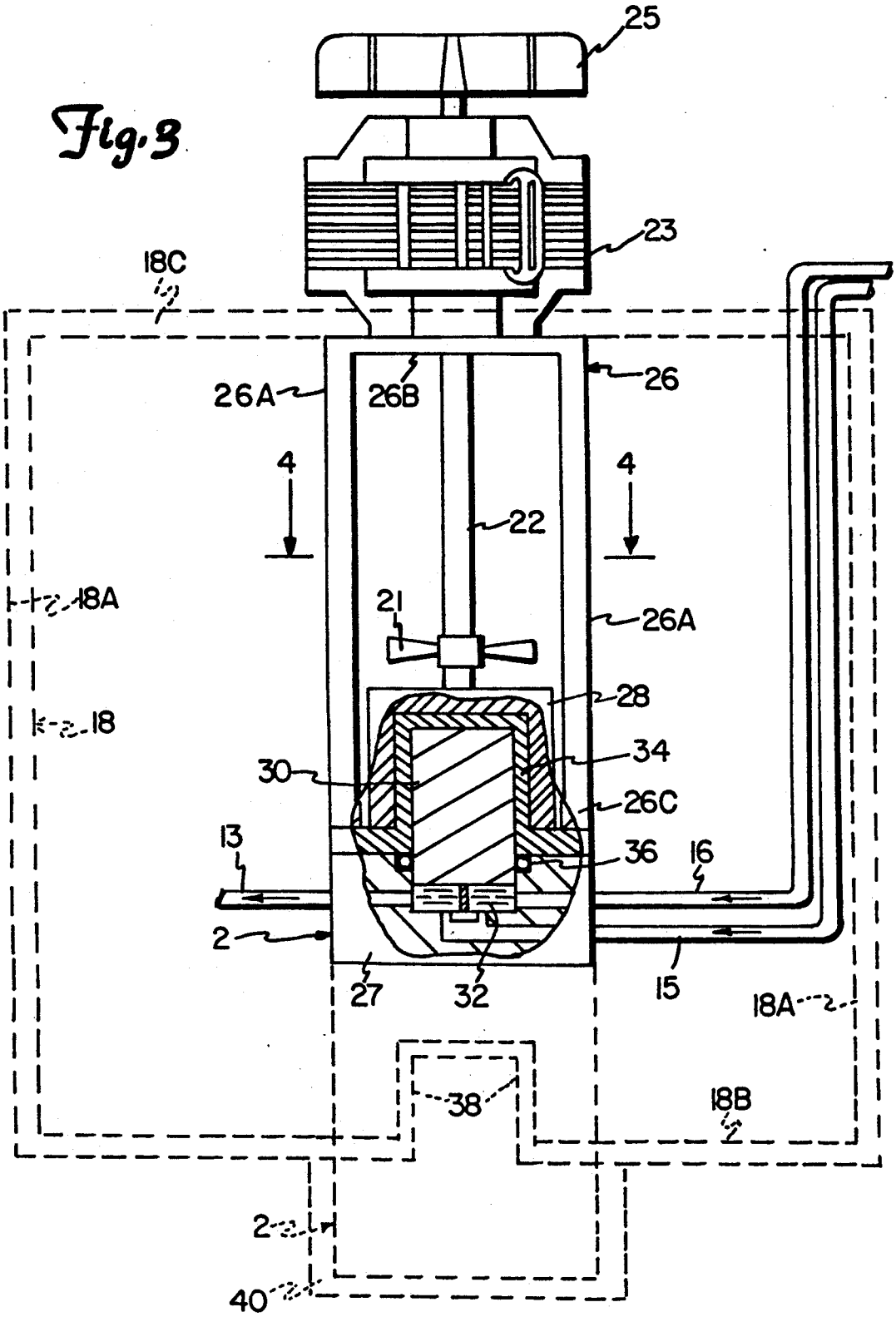
FIG. 3 is a partial cross-sectional side elevational view of a recirculating pump and agitator system of the present invention.

The combination of the agitator, pump and motor is shown in more detail in FIGS. 3 and 4. Electric motor 23, which forms the drive means for the combination device or system, comprises a two-pole motor having a cooling fan 25. Motor 23 is connected to a frame 26 having four support rods 26*a* extending between and secured to a top frame portion 26*b* and a bottom frame portion 26*c*. Frame portion 26*a* and motor 23 are secured together and to reservoir cover 28*c*, and pump housing 27 is connected to frame portion 26*c*. Agitator paddle or blades 21 are mounted on shaft 22 and the end of shaft 22 terminates in a magnetic coupling 24.

As will be understood by those of skill, coupling 24 includes an external magnet 28 attached to shaft 22 and an internal magnet 30. Magnet 30 is joined with an impeller 32 of pump 2, and magnets 28 and 30 are separated by a non-ferromagnetic spacer 34 held between frame portion 26*c* and pump housing 27. An o-ring 36 provides for sealing between spacer 34, housing 27 and magnet 30.

A seen in FIG. 3, pump 2 is immersed in the coolant water 17. In operation, motor 23 turns shaft 22 and agitator 21, and through the magnetic coupling attraction of magnets 28 and 30 simultaneously operates pump 2. As a result thereof, impeller 32 causes the circulating of carbonated water through circuit 1. This circulation is accomplished with pump 2 held below water surface 17*a*. It can be appreciated that such immersion is permitted because the magnetic coupling avoids the need for shaft seals so that pump 2 can be completely isolated from water 17. There is, therefore, no danger that water 17 could enter pump 2 and contaminate the beverage or carbonated water circulating therethrough. The absence of such seals also ensures that the friction that would otherwise be caused thereby is not present and, therefore, motor 23 can be of the smallest size practicable. Furthermore, because pump 2 is immersed in water 17 and is not in the open air, the risk of condensation damage to motor 23 is greatly reduced, if not eliminated.

It can be understood that frame 26 provides for the rigid stabilizing connection of motor 23 to pump 2 so that during operation of motor 23, pump 2 is held firmly in position and prevented from rotating. In addition, the location of motor 23 above reservoir 18 facilitates dissipation of any heat generated by the operation thereof into the ambient air, and the securing thereof to a top lid or cover 18*c* keeps the combination pump/agitator/motor unit or device in the proper position within reservoir 18.

In an alternative embodiment, pump 2 has a single inlet wherein a line 15', shown in ghost outline in FIG. 1, replaces line 15 and provides for replenishing connection from carbonator 8 directly to circuit 1. This approach eliminates the need for the inlet port 7 and any associated seals. In a further embodiment, as seen by referring to FIG. 2, the feed line or lines to pump 2 may be led over the top of a sidewall 28*a* so as to avoid the need for seals in the wall of the reservoir.

As seen in ghost outline in FIG. 2, it can be appreciated that pump 2 can be located on the exterior of bottom wall 18*b* wherein a portion 38 thereof can be used as a substitute for spacer 34 provided, of course, that such bottom wall portion is made of a non-ferromagnetic material. When mounted in this exterior position it is desirable to cover pump 2 with an insulating layer 40 to prevent condensation damage to pump 2 or its surroundings.

What is claimed is:

1. An agitating and pumping device for use in a beverage cooling system, the cooling system having a reservoir containing a liquid, the liquid having a top surface, and cooling means in the liquid for the cooling thereof, and a heat exchange coil in heat exchange relationship with the reservoir liquid for cooling a beverage as it is circulated through the coil, the agitating and pumping device, comprising:

drive means connected to agitating means for agitating the liquid within the reservoir, the drive means secured above the liquid top surface and the agitating means extending into the liquid therebelow, and means for magnetically coupling the agitating means to a pump means, the pump means fluidly connected to the heat exchange coil for circulating the beverage therethrough.

2. The ice-bank system as defined in claim 1, and the pump means submerged in the water of the reservoir.

3. The ice-bank system as defined in claim 1, and the drive means secured to a rigid reservoir top cover.

4. The device as defined in claim 1, and the pump having a first inlet and an outlet fluidly connected to the heat exchange coil, and having a second inlet fluidly connected to a source of beverage.

5. The device as defined in claim 1, wherein the source of beverage is a carbonator.

6. The device as defined in claim 1, wherein the cooling liquid is water.

7. The device as defined in claim 1, and the drive means secured to a rigid reservoir top cover.

8. The device as defined in claim 1, and the agitating means comprising agitator blades secured to a shaft driven by the drive means.

9. The device as defined in claim 8, and further including a stabilizing frame for rigidly connecting the drive means to the pump means.

10. The device as defined in claim 9, and the shaft extending substantially centrally of the stabilizing frame.

11. The device as defined in claim 1, and the pump located on an exterior wall of the reservoir the exterior wall being formed at least in part of a non-ferromagnetic material for permitting the magnetic coupling between the pump means and the agitator means.

12. The device as defined in claim 11, and the pump means covered by insulating means.

13. The device as defined in claim 1, wherein the drive means is an electric motor.

14. The device as defined in claim 13, and the electric motor is of the two-pole type.

15. An ice-bank system, comprising:

a reservoir for holding a volume of water, a refrigeration coil in the reservoir and connected to refrigeration means for forming an ice-bank on the coil from a portion of the reservoir water, drive means outside of the reservoir and connected to agitating means for agitating the water in the reservoir, and magnetic coupling means for coupling the agitating means to a pump means, the pump means in fluid communication with a supply of beverage and with a heat exhange circuit, the circuit in heat exchange relationship with the water in the reservoir and the pump means for providing circulating of the beverage supplied thereto through the heat exchange circuit.

16. The ice-bank system as defined in claim 15, and the pump means submerged in the water of the reservoir.

17. The ice-bank system as defined in claim 15, and the drive means secured to a rigid reservoir top cover.

18. The ice-bank system as defined in claim 15, and the pump means having a first inlet and an outlet fluidly connected to the circuit, and having a second inlet fluidly connected to a source of beverage.

19. The ice-bank system as defined in claim 15, wherein the source of beverage is a carbonator.

20. The ice-bank system as defined in claim 15, and the pump means secured to the drive means by a stabilizing frame.

21. The ice-bank as defined in claim 20, and the shaft extending substantially centrally of the stabilizing frame.

22. The ice-bank system as defined in claim 21, and the agitating means comprising agitator blades secured to a shaft driven by the drive means.

23. The ice-bank system as defined in claim 15, and the pump located on an exterior wall of the reservoir which exterior wall is formed at least in part of a non-ferromagnetic material for permitting the magnetic coupling between the pump means and the agitator means.

24. The ice-bank system as defined in claim 23, and the pump means covered by insulating means.

25. The ice-bank system as defined in claim 15, wherein the drive means is an electric motor.

26. The ice-bank system as defined in claim 25, and the electric motor is of the two-pole type.

* * * * *